US012745855B2

(12) United States Patent
Grutta et al.

(10) Patent No.: US 12,745,855 B2
(45) Date of Patent: Sep. 29, 2026

(54) CUSHIONING ELEMENTS WITH PRESSURIZABLE CELLS

(71) Applicant: Purple Innovation, LLC, Lehi, UT (US)

(72) Inventors: James T. Grutta, Draper, UT (US); Russell B. Whatcott, Eagle Mountain, UT (US); Brett Pearson, Taylorsville, UT (US)

(73) Assignee: Purple Innovation, LLC, Lehi, UT (US)

( * ) Notice: Subject to any disclaimer, the term of this patent is extended or adjusted under 35 U.S.C. 154(b) by 362 days.

(21) Appl. No.: 18/234,334

(22) Filed: Aug. 15, 2023

(65) Prior Publication Data

US 2023/0380600 A1 Nov. 30, 2023

Related U.S. Application Data

(63) Continuation of application No. 17/682,649, filed on Feb. 28, 2022, now Pat. No. 11,723,476.

(60) Provisional application No. 63/154,423, filed on Feb. 26, 2021.

(51) Int. Cl.
*A47C 27/08* (2006.01)

(52) U.S. Cl.
CPC ..... *A47C 27/081* (2013.01)

(58) Field of Classification Search
CPC ..... A47C 27/00; A47C 27/081; A47C 27/087; A47C 27/10; A47C 27/142; A47C 21/046; A47C 7/425; A47G 9/1027; A47G 2009/003
USPC ..... 5/706, 654, 655.3, 710; 383/3
See application file for complete search history.

(56) References Cited

U.S. PATENT DOCUMENTS 2,731,652 A 1/1956 Bishop
3,251,075 A * 5/1966 Saltness ..... A47G 9/1027 383/3
4,982,466 A * 1/1991 Higgins ..... A47C 27/10 5/713
5,022,109 A 6/1991 Pekar
5,640,731 A 6/1997 Toedter
(Continued)

FOREIGN PATENT DOCUMENTS

CN 110831466 A 2/2020
WO WO-2020081908 A1 * 4/2020 ..... B32B 7/05

OTHER PUBLICATIONS

Taiwan Intellectual Property Office, "Office Action," Taiwan Application No. 112107362, Nov. 9, 2023.
(Continued)

*Primary Examiner* — David R Hare
(74) *Attorney, Agent, or Firm* — Foley & Lardner LLP

(57) ABSTRACT

A cushioning element includes pressurizable cells. The pressurizable cells of the cushioning elements are grouped into a plurality of sets, with each set of pressurizable cells being independently pressurizable from every other set of pressurizable cells of the cushioning element. The pressurizable cells may extend across a widths of the cushioning element and be arranged in series along the length of the cushioning element. Such a cushioning element may be part of a cushion, such as a mattress, a mattress topper, or the like. Methods for manufacturing the cushioning elements are also disclosed.

14 Claims, 4 Drawing Sheets

(56) References Cited

U.S. PATENT DOCUMENTS

| | | | | |
|---|---|---|---|---|
| 6,415,467 | B1 * | 7/2002 | Bretvin | A61G 7/05769 5/713 |
| 6,510,573 | B1 * | 1/2003 | Grabe | A47G 9/1027 5/490 |
| 8,332,979 | B2 | 12/2012 | Flick et al. | |
| 8,904,584 | B2 * | 12/2014 | Sugano | B29D 22/00 5/652 |
| 11,213,139 | B2 | 1/2022 | Harris et al. | |
| 11,723,476 | B2 * | 8/2023 | Grutta | A47C 27/081 5/706 |
| 2005/0097674 | A1 * | 5/2005 | Mileti | A61G 7/05776 5/710 |
| 2013/0133138 | A1 | 5/2013 | Sugano et al. | |

OTHER PUBLICATIONS

Taiwan Intellectual Property Office, "Notice of Allowance," Taiwan Application No. 112107362, May 21, 2024.

USPTO acting as International Searching Authority, "International Search Report and Written Opinion," International Application No. PCT/US2022/018173, May 18, 2022.

* cited by examiner

CUSHIONING ELEMENTS WITH PRESSURIZABLE CELLS

CROSS-REFERENCE TO RELATED APPLICATION

This application is a continuation of U.S. patent application Ser. No. 17/682,649, filed on Feb. 28, 2022 and titled CUSHIONING ELEMENTS WITH PRESSURIZABLE CELLS ("the '649 Application"), now U.S. Pat. No. 11,723,476, which issued on Aug. 15, 2023. The '649 Application includes a claim for priority to the Feb. 26, 2021 filing date of U.S. Provisional Patent Application No. 63/154,423, titled CUSHIONING ELEMENTS WITH PRESSURIZABLE CELLS ("the '423 Provisional Application"), pursuant to 35 U.S.C. § 119(e). The entire disclosures of the '423 Provisional Application and the '649 Application are hereby incorporated herein.

TECHNICAL FIELD

This disclosure relates generally to cushioning elements and more specifically to cushioning elements with pressurizable cells. Even more specifically, this disclosure relates to cushioning elements with pressurizable cells that extend across the widths of the cushioning elements and are arranged in series along the lengths of the cushioning elements. Such a cushioning element may be part of a mattress of a so-called "airbed," a hybrid mattress, a mattress topper, or any of a variety of other types of cushions. This disclosure also relates to methods for manufacturing cushioning elements that include pressurizable cells.

SUMMARY

A cushioning element according to this disclosure includes a planar intermediate element, a series of first bladders on a first side (e.g., a top side, a bottom side, etc.) of the planar intermediate element, a series of second bladders on a second side (e.g., a bottom side, a top side, etc.) of the planar intermediate element, and a plurality of apertures extending through the planar intermediate element. Each first bladder may extend over at least one aperture through the planar intermediate element and be completely superimposed with a corresponding second bladder to define a pressurizable cell (or, more simply, a cell) of the cushioning element. Thus, the series of first bladders, the planar intermediate element, and the series of second bladders may define a series of cells of the cushioning element. Conduits may extend between at least some adjacent cells or, more specifically, between adjacent first bladders and/or adjacent second bladders.

The first side, or a first surface, of the planar intermediate element is opposite from the second side, or a second surface, of the planar intermediate element. Thus, the first side may define a top side of the planar intermediate element while the second side may define a bottom side of the planar intermediate element. Alternatively, the first side may define a bottom side of the planar intermediate element while the second side may define a top side of the planar intermediate element. In addition to the first side and the second side, the planar intermediate element has a length and a width.

Again, a plurality of apertures may extend through the planar intermediate element, from the first side to the second side. The apertures may be arranged in one or more columns along the length of the planar intermediate element. The apertures may also be arranged in rows across the width of the planar intermediate element. In some embodiments, an array of apertures may be defined through the planar intermediate element.

Each first bladder may be arranged over a row of apertures through the planar intermediate element and extend substantially or completely across the width of the planar intermediate element. As used in this context, the term "substantially" indicates that side edges of the planar intermediate element may extend slightly beyond (e.g., by about 1 cm or less, about 5 mm or less, about 2 mm or less, about 1 mm or less, etc.) ends each first bladder. Edges (e.g., a top edge, a bottom edge, end edges, etc.) of each first bladder may be secured to and sealed against the first side of the planar intermediate element. Together, the first bladder, its edges, and the portion of the planar intermediate element covered by the first bladder may define a first chamber. In some embodiments, including but not limited to embodiments where the first bladder is to be independent from an adjacent first bladder, an entire edge of the first bladder may be secured to and sealed against the first side of the planar intermediate element. In embodiments where the first bladder is to communicate with an adjacent first bladder, an intermediate portion of the edge between the adjacent first bladders may remain unsealed from the first side of the planar intermediate element to define a conduit between the adjacent first bladders. In some embodiments, each first bladder may be semi-cylindrical in shape.

Each second bladder may also be arranged over a row of apertures through the planar intermediate element and extend substantially or completely across the width of the planar intermediate element. Edges (e.g., a top edge, a bottom edge, end edges, etc.) of each second bladder may be secured to and sealed against the second side of the planar intermediate element. Together, the second bladder, its edges, and the portion of the planar intermediate element covered by the second bladder may define a second chamber. In some embodiments, including but not limited to embodiments where the second bladder is to be independent from an adjacent second bladder, an entire edge of the second bladder may be secured to and sealed against the second side of the planar intermediate element. In embodiments where the second bladder is to communicate with an adjacent second bladder, an intermediate portion of the edge between the adjacent second bladders may remain unsealed from the second side of the planar intermediate element to define a conduit between the adjacent second bladders. In some embodiments, each second bladder may be semi-cylindrical in shape.

In embodiments where each first bladder and each second bladder extends across the width of the planar intermediate element and the series of first bladders, the series of second bladders extend along the length of the planar intermediate element, and each of the first bladders is completely superimposed with a corresponding second bladder, the first bladders, corresponding second bladders, and portions of the planar intermediate element therebetween may define a series of cells. Each cell may extend across a width of the cushioning element. The series of cells may be arranged along a length of the cushioning element. In embodiments where a first bladder and a corresponding bladder are semi-cylindrical in shape and completely superimposed with each other, the resulting cell may be cylindrical in shape.

Various cells of the cushioning element may be grouped together. For example, a first set of cells may be located adjacent to a first end of the cushioning element (e.g., a head of the cushioning element, etc.), while a second set of cells may be located adjacent to a second end of the cushioning element (e.g., a foot of the cushioning element, etc.). In some embodiments, a third set of cells or even further sets of cells may be located between the first set and the second set (e.g., at one or more intermediate locations along the length of the cushioning element, etc.). In some embodiments, the cells of each set may communicate with each other (e.g., by way of conduits therebetween, etc.) but not with the cells of any other group.

As an alternative to separate sets of cells (e.g., separately pressurizable sets of cells, etc.) formed using the same planar intermediate element, a series of cushioning elements may be positioned adjacent to one another. In such embodiments, one or more of the cushioning elements may include cells that communicate with each other (e.g., by way of conduits therebetween, etc.).

The ends of the first bladders and the second bladders may be sealed in any suitable manner. For example, a cap may be assembled with and sealed to each end of each cell defined by a first bladder and second bladder that correspond to one another and against locations on the planar intermediate element adjacent to peripheries of the corresponding first bladder and second bladder.

In another aspect, methods for manufacturing a cushioning element are disclosed. Such a method includes providing a planar intermediate element, positioning at least one first sheet of material over a first side of the planar intermediate element, and selectively securing portions of the at least one first sheet to a first side of the planar intermediate element. Such selective securing may include securing spaced-apart, parallel locations of the at least one first sheet to corresponding spaced-apart, parallel locations extending substantially across the width of the planar intermediate element on the first side of the planar intermediate element. The result of such selective securing may include the definition of a series of first bladders over the first surface. The locations at which the at least one first sheet is secured to the first side may result in the definition of a first bladder that extends over at least one aperture the planar intermediate element.

In addition to securing the at least one first sheet to the first side of the planar intermediate element, the method includes positioning at least one second sheet of material over a second side of the planar intermediate element and selectively securing portions of the at least one second sheet to the second side of the planar intermediate element. Such selective securing may include securing spaced-apart, parallel locations of the at least one second sheet to corresponding spaced-apart, parallel locations extending substantially across the width of the planar intermediate element on the second side of the planar intermediate element. The result of such selective securing may include the definition of a series of second bladders over the second surface. The locations at which the at least one second sheet is secured to the second side may result in the definition of a second bladder that extends over at least one aperture the planar intermediate element. In embodiments where the second bladders are completely superimposed with the first bladders, the result of such selective securing may also the definition of a series of pressurizable cells arranged along a length of the cushioning element.

A first sheet may be used to define a plurality of adjacent first bladders, including the first bladders of a set of cells of the cushioning element. In some embodiments, a single first sheet may be used to define all of the first bladders of a cushioning element. Similarly, a plurality of second bladders (e.g., a set of second bladders, all of the second bladders, etc.) may be defined with a second sheet.

In some embodiments, selective securing of a first sheet and/or a second sheet to a corresponding first side and/or second side of the planar intermediate element may include sealing the first sheet and/or second sheet to the corresponding first side and/or second side across an entire width of the first sheet and/or second sheet. In other embodiments, the first sheet and/or second sheet may remain unsealed from the first side and/or second side at one or more intermediate locations to define a conduit between adjacent bladders.

Ends of the first bladders and the second bladders may be sealed. In some embodiments, ends of the first and second bladders may be sealed by securing the ends to and sealing the ends against the corresponding first and second sides of the planar intermediate element. In other embodiments, a cap may be assembled with and sealed to an end of each cell defined by a first bladder and its corresponding second bladder.

Other aspects of the disclosed subject matter, as well as features and advantages of various aspects of the disclosed subject matter, should become apparent to those of ordinary skill in the art from the preceding disclosure, the description and drawings that follow, and the appended claims.

DETAILED DESCRIPTION

Figure 1:
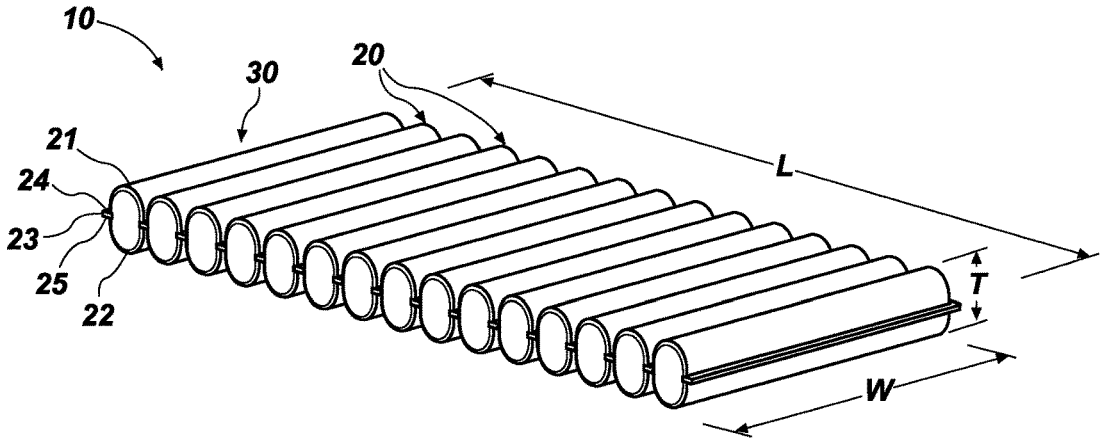
FIG. 1 is a perspective view of an embodiment of a cushioning element with pressurizable cells that may grouped into separately inflatable sets.

FIGS. 1-4 depict an embodiment of a cushioning element 10. The cushioning element 10 includes a series 30 of elongated cells 20 (or, more simply, cells 20), with each cell 20 extending across a width W of the cushioning element 10 and the series 30 arranged along a length L of the cushioning element 10. The cells 20 are defined by a series of first bladders 21 on a first side 24 of a planar intermediate element 23 and a series of second bladders 22 on a second side 25 of the planar intermediate element 23. Each first bladder 21 is completely superimposed with a corresponding second bladder 22.

Figure 5:
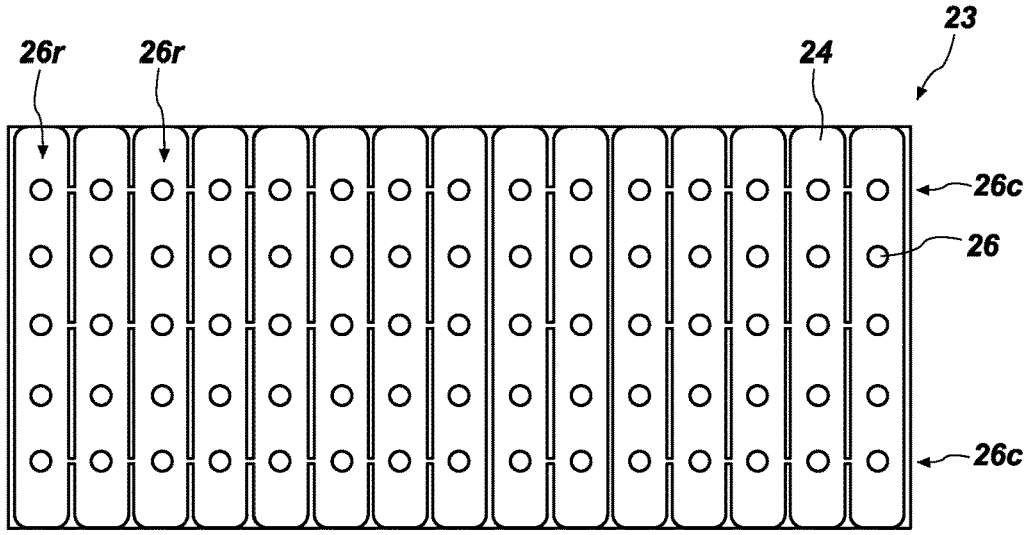
FIG. 5 is a cross-sectional view of the embodiment of the cushioning element shown in FIG. 1, taken midway between major surfaces of the cushioning element along a length of the cushioning element and across a width of the cushioning element.
Figure 6:
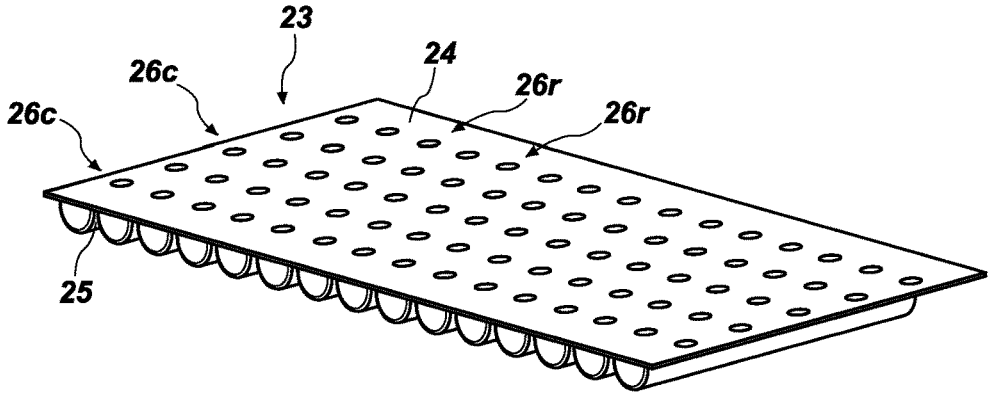
FIG. 6 is a perspective cross-sectional view of the embodiment of the cushioning element shown in FIG. 1, taken partially between major surfaces of the cushioning element along the length of the cushioning element and across the width of the cushioning element to show a planar intermediate element of the cushioning element.

As depicted by FIGS. 5 and 6, the planar intermediate element 23 may include apertures 26 extending through its thickness, from the first side 24 to the second side 25 of the planar intermediate element 23. The apertures 26 may be arranged in one or more columns 26*c* along a length of the planar intermediate element 23. The apertures 26 may also be arranged in rows 26*r* across a width of the planar intermediate element 23. The apertures 26 in each column 26*c* may be spaced equidistantly apart from each other, which spaces the rows 26*r* equidistantly along the length of the planar intermediate element 23. In some embodiments, such as that depicted by FIGS. 5 and 6, an array of apertures 26 may be defined through the planar intermediate element. Alternatively, the apertures 26 may be randomly positioned rather than equidistantly positioned across the planar intermediate element 23.

Figure 7:
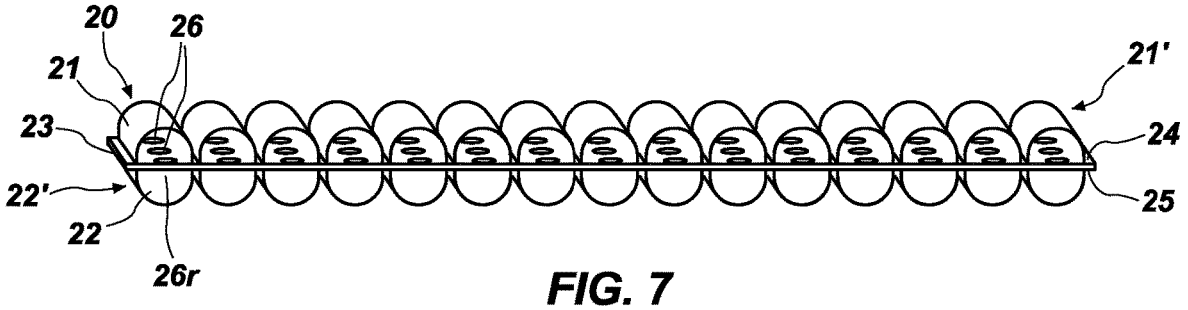
FIG. 7 is another perspective cross-sectional view of the embodiment of the cushioning element shown in FIG. 1, taken transverse to a thickness of the cushioning element and along the length of the cushioning element.

As shown in FIG. 7, each cell 20 may be defined by a first bladder 21 and a corresponding second bladder 22 on opposite sides of the planar intermediate element 23. The first bladder 21 may be secured to and sealed against the first side 24 of the planar intermediate element 23. The first bladder 21 and second bladder 22 may be positioned over a row 26*r* of apertures 26 through the planar intermediate element 23. The corresponding first bladder 21 and second bladder 22 may be superimposed with each other.

The planar intermediate element 23 may be formed from any suitable material. In some embodiments, the planar intermediate element 23 may be made from the same material used to form the first bladder 21 and the second bladder 22. The planar intermediate element 23 may be formed from a sheet of a polymeric material (e.g., a plastic). The planar intermediate element 23 may be flexible. Alternatively, the planar intermediate element 23 may be somewhat rigid. A rigidity of the planar intermediate element 23 may be due the material from which it is formed, a thickness of the sheet that defines it, or a combination of material and sheet thickness.

The first bladders 21 and second bladders 22 may be formed from a pliable material, such as a polymeric film, that is impermeable or substantially impermeable (e.g., accounting for tolerable rates of decreased pressure (e.g., 1 psi per 24 hours, 1 psi per 48 hours, 1 psi per 72 hours, 1 psi per week, etc.) to one or more suitable gases (e.g., nitrogen, air, etc.) under ambient conditions (e.g., pressure, room temperature, etc.). A pliability of the first bladders 21 and the second bladders 22 may be attributed to the material used to form the first bladders 21 and the second bladders 22, a film thickness of the material, or a combination thereof.

In some embodiments, a single sheet of pliable material may be used to form a plurality of adjacent first bladders 21 or second bladders 22, with various spaced-apart portions that extend at least partially across a width of the sheet material and are secured to and sealed against the planar intermediate element 23 defining the edges of the adjacent first bladders 21 or second bladders 22. In some embodiments, a single sheet of pliable material may be used to form all of the first bladders 21 on the first side 24 of the planar intermediate element 23. Similarly, a single sheet of pliable material may be used to form all of the second bladders 22 on the second side 25 of the planar intermediate element 23. The material from which the first bladders 21 and second bladders 22 are made may be less rigid than a material from which the planar intermediate element 23 is made.

In other embodiments, a single sheet of material may be used to form the planar intermediate element 23, the first bladders 21, and the second bladders 22.

Figure 2:
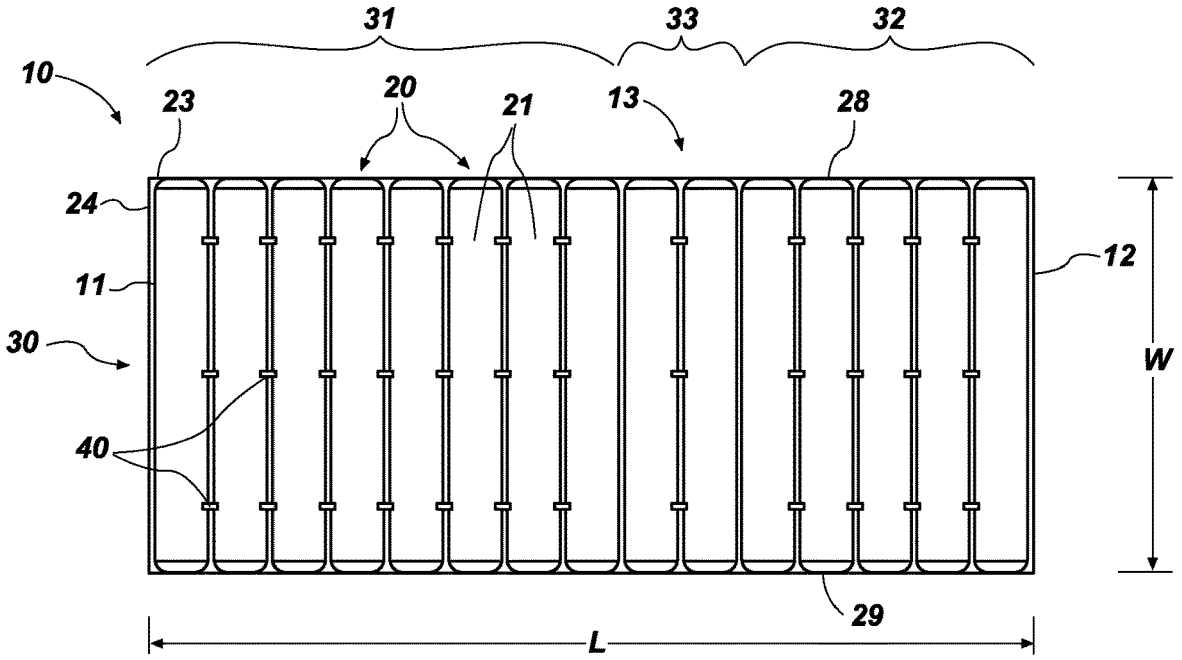
FIG. 2 is a top view of the embodiment of the cushioning element shown in FIG. 1.
Figure 3:
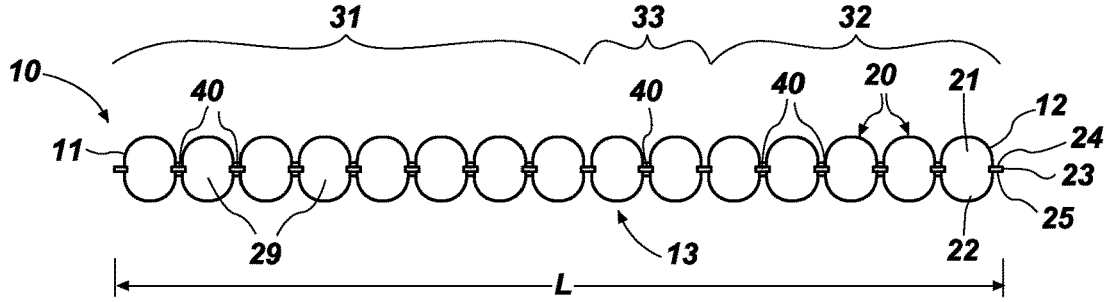
FIG. 3 is a side view of the embodiment of the cushioning element shown in FIG. 1.
Figure 4:
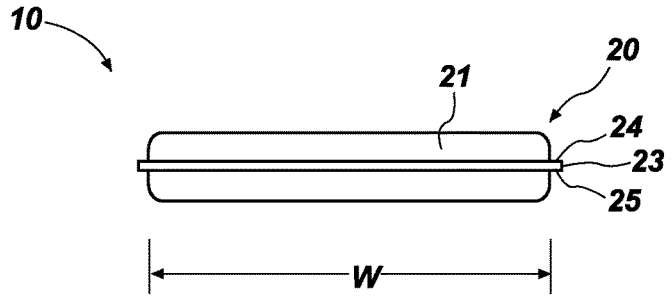
FIG. 4 is an end view of the embodiment of the cushioning element shown in FIG. 1.

As illustrated by FIGS. 2 and 3, the ends 28, 29 of each cell 20 may be sealed. More specifically, edges of the ends 28, 29 of the corresponding first bladder 21 and second bladder 22 that define each cell 20 may be sealed against the corresponding first side 24 and second side 25 of the planar intermediate element 23. Alternatively, caps (not shown) may be assembled with, secured to, and sealed to each end 28, 29 of each cell 20.

Figure 8:
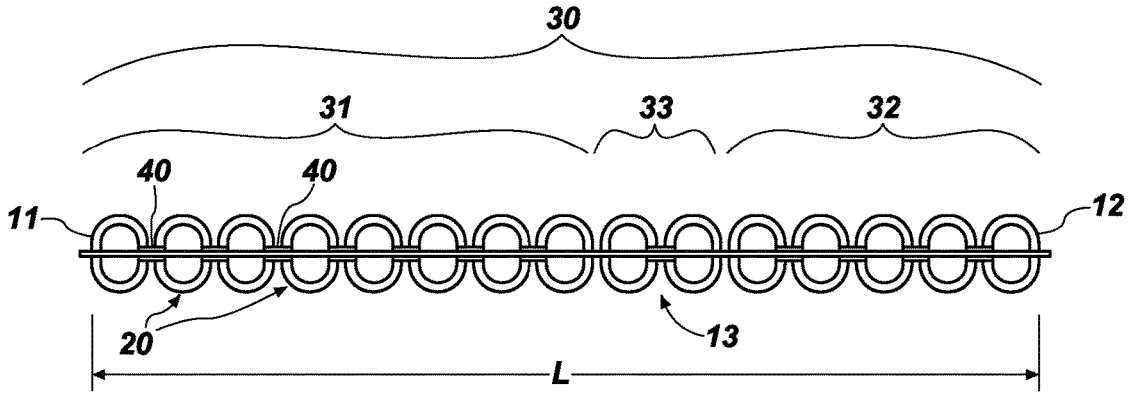
FIG. 8 is another cross-sectional view of the embodiment of the cushioning element shown in FIG. 1, taken transverse to a thickness of the cushioning element and along the length of the cushioning element.
Figure 9:
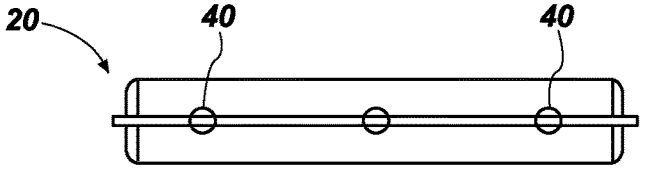
FIG. 9 is yet another cross-sectional view of the embodiment of the cushioning element shown in FIG. 1, taken transverse to the thickness of the cushioning element and at a first location across the width of the cushioning element.

With returned reference to FIGS. 2 and 3, as well as with reference to FIG. 8, the series 30 of cells 20 of the cushioning element may include a plurality of sets 31, 32, 33, etc., of cells 20. For example a first set 31 of cells 20 may be located adjacent to a first end 11 (e.g., a head, a foot, etc.) of the cushioning element 10. In the illustrated embodiment, the first set 31 of cells 20 includes the first through eighth cells 20 (from left to right) of the series 30. The series 30 of cells 20 may also include a second set 32 of cells 20 adjacent to a second end 12 (e.g., a foot, a head, etc.) of the cushioning element 10. In the illustrated embodiment, the second set 32 of cells 20 includes the eleventh through fifteenth cells 20 (from left to right) of the series 30. Optionally, the series 30 of cells 20 may also include a third set 33 of cells 20 at an intermediate location 13 (e.g., a thigh location, a lumbar location, etc.) along the length L of the cushioning element 10. In the illustrated embodiment, the third set 33 of cells 20 includes the ninth and tenth cells 20 (from left to right) of the series 30. As an alternative to a single cushioning element 10 with physically connected sets 31, 32, 33, etc., of cells 20, a series of cushioning elements may be positioned adjacent to one another, or end-to-end. An orientation of the cushioning element 10 within a mattress may determine which end 11, 12 thereof is located adjacent to the head of the mattress and which end 11, 12 of the cushioning element 10 is located adjacent to the foot of the mattress.

The cells 20 of each set 31, 32, 33, etc., may communicate with one another by way of one or more conduits 40 between adjacent cells 20, as illustrated by FIGS. 2, 3, 8, and 9. Thus, as pressure within one cell 20 of a set 31, 32, 33, etc., is adjusted, the adjustment in pressure may be communicated to an adjacent cell 20 of the same set 31, 32, 33, etc., which may also cause pressure within the adjacent cell 20 to be adjusted. The conduits 40 may comprise unsealed locations between adjacent cells 20 of the same set 31, 32, 33, etc. Alternatively, the conduits 40 may comprise tubular elements that establish communication between adjacent cells 20.

The conduits 40 may be positioned relatively centrally, or away from the ends 28 and 29 of the cells 20 they establish communication between. Alternatively, as depicted, the conduits 40 may be spaced evenly, or equidistantly, between the ends 28 and 29 of the cells 20 they extend between. As another option, the conduits 40 may be positioned adjacent to, along, or near the ends 28 and 29 of the cells 20 they establish communication between. As yet another option, the conduits 40 may establish communication between adjacent cells through adjacent ends 28 or 29 of the adjacent cells 20; such a conduit 40 may be located beyond, or outside, of the ends 28 or 29 of the cells 20. It should be appreciated that the conduits 40 may be positioned at any of a variety of locations relative to the widths W of the cells 20 they connect. In some embodiments, conduits 40 may connect cells 20 that are not adjacent to each other.

Figure 10:
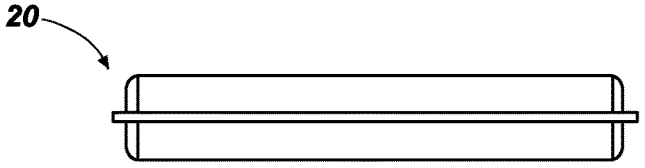
FIG. 10 is still another cross-sectional view of the embodiment of the cushioning element shown in FIG. 1, taken transverse to the thickness of the cushioning element and at a second location across the width of the cushioning element.

Notably, conduits 40 do not extend between adjacent cells 20 of different sets 31, 32, 33, etc., which enables each set 31, 32, 33, etc., to be pressurized independently of other sets 31, 32, 33, etc. FIG. 10 illustrates a side of a cell 20 that lacks conduits 40, such as the adjacent sides of the eighth and ninth cells 20 of FIG. 2 and the tenth and eleventh cells 20 of FIG. 2. Notably, there are no conduits on side of a cell 20 that defines a boundary between two adjacent sets 31 and 32, 32 and 33, etc., of cells 20 or between adjacent cushioning elements. However, in some embodiments, a cushioning element may include a single set of cells 20, with conduits 40 connecting each adjacent pair of cells 20 of the series 30, thereby fluidly connecting each cell 20 to every other cell 20 of the series 30.

Referring again to FIG. 7, an embodiment of a method for manufacturing a cushioning element 10 is described. In such a method, a planar intermediate element 23 is provided. At least one first sheet 21' of material is positioned over the first side 24 of the planar intermediate element 23. Portions (e.g., linear portions, etc.) of the at least one first sheet 21' are secured to the first side 24 of the planar intermediate element 23 (e.g., by way of thermal bonding, welding (e.g., ultrasonic, RF, etc.), use of an adhesive, etc.). Such a portion may extend continuously across a width of the at least one second sheet 22' or it may include one or more gaps that may define one or more conduits 40. Selective securing may include securing spaced-apart, parallel locations of the at least one first sheet 21' to corresponding spaced-apart, parallel locations extending substantially across the width of the planar intermediate element 23 on the first side 24 of the planar intermediate element 23. The spaced-apart, parallel locations may be on opposite sides of a row **26*r* of apertures 26 and between adjacent rows 26*r* of apertures 26. The result of such selective securing may include the definition of a series of first bladders 21 over the first surface 24. The locations at which the at least one first sheet 21' is secured to the first side 24 may result in the definition of a first bladder 21 that extends over a row 26*r* or apertures 26 through the planar intermediate element 23**.

In addition to securing the at least one first sheet 21' to the first side 24 of the planar intermediate element 23, at least one second sheet 22' of material may be positioned over the second side 25 of the planar intermediate element 23. Portions (e.g., linear portions, etc.) of the at least one second sheet 22' may be secured to the second side 25 of the planar intermediate element 23 (e.g., by way of thermal bonding, welding, use of an adhesive, etc.). Such a portion may extend continuously across a width of the at least one second sheet 22' or it may include one or more gaps that may define one or more conduits 40. Spaced-apart, parallel locations of the at least one second sheet 22' may be secured to corresponding spaced-apart, parallel locations extending substantially across the width of the planar intermediate element 23 on the second side 24 of the planar intermediate element 23. The spaced-apart, parallel locations may be on opposite sides of a row **26*r* of apertures 26 and between adjacent rows 26*r* of apertures 26. The result of such selective securing may include the definition of a series of second bladders 22 over the second surface 25. The locations at which the at least one second sheet 22' is secured to the second side 24 may result in the definition of a second bladder 22 that extends over a row 26*r* of apertures 26 through the planar intermediate element 23. In embodiments where the second bladders 22 are completely superimposed with the first bladders 21, the result of such selective securing may also the definition of a series 30 of cells 22 arranged along the length L of the cushioning element 10**.

In some embodiments, locations adjacent to edges of the at least one first sheet 21' and the at least one second sheet 22' may be secured to the first side 24 and second side 25, respectively, of the planar intermediate sheet 23 to define ends of the first bladders 21 and the second bladders 22 and, thus, ends of the cells 20. Alternatively, a cap (not shown) may be assembled with and sealed to an end of each cell 20.

Figure 11:
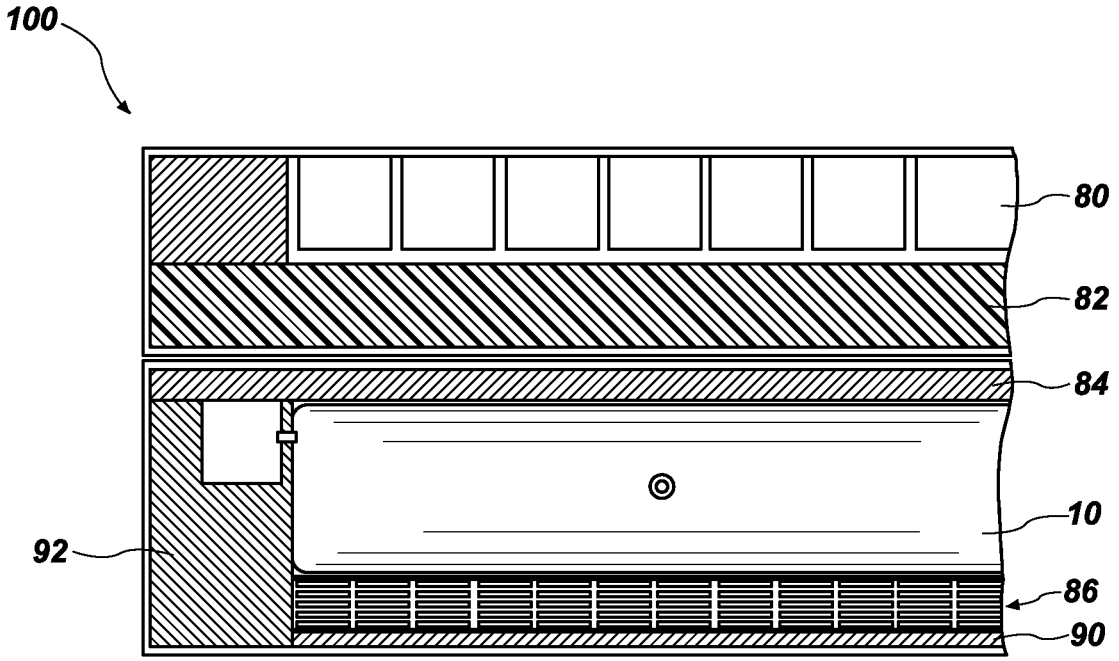
FIG. 11 is a schematic representation of an embodiment of a mattress that includes a cushioning element such as that depicted by FIGS. 1-10.

Turning now to FIG. 11, the cushioning element 10 and, more specifically, the interiors of the sets 31, 32, 33, etc., of cells 20 of the cushioning element 10, may communicate with a pressure source 50 (e.g., an air compressor, etc.), which may operate under control of a processing element 60 to enable adjustment and maintenance of a desired pressure within each cell 20 or set 31, 32, 33, etc., of cells 20 of the cushioning element 10.

Furthermore, it should be appreciated that the cushioning element 10 may include a single pressure source 50 connected to a plurality of sets 31, 32, 33, etc., or to each set 31, 32, 33, etc., of cells 20, with a valve determining the set 31, 32, 33, etc., to which the pressure source 50 will communicate, or cause, a pressure change (e.g., inflation, deflation, etc.). Alternatively, a plurality of pressure sources 50 may be fluidly connected to the cushioning element 10, with each pressure source 50 dedicated and fluidly connected to a specific set 31, 32, 33, etc., of cells 20 to allow for appropriate pressurization of that set 31, 32, 33, etc. Access to each set 31, 32, 33, etc., may be from either of the ends 28 and 29 of a cell 20 or from any number of locations of each set 31, 32, 33, etc., or each cell 20 or the cushioning element 10.

The cushioning element 10 may be combined with one or more other elements of a cushion 100, such as a cover 70, one or more cushioning layers 80, 82, 84, etc. (e.g., foam 82, 84, memory foam 84, elastomeric grid 80, coils 86, etc.), and support 90 and foundational elements 92 to define a mattress, a mattress topper, or any of a variety of other embodiments of cushions 100. Without limitation, such a cushion 100 may comprise mattress such as that described by U.S. Pat. No. 11,213,139, the entire disclosure of which is hereby incorporated herein.

Although the preceding disclosure provides many specifics, these should not be construed as limiting the scope of any of the claims that follow, but merely as providing illustrations of some embodiments of elements and features of the disclosed subject matter. Other embodiments of the disclosed subject matter, and of their elements and features, may be devised which do not depart from the spirit or scope of any of the claims. Features from different embodiments may be employed in combination. Accordingly, the scope of each claim is limited only by its plain language and the legal equivalents thereto.

What is claimed:

1. A cushioning element, comprising:

a planar support;

a plurality of pressurizable cells carried and at least partially defined by the planar support, the plurality of pressurizable cells including a first set of adjacent pressurizable cells and a second set of adjacent pressurizable cells extending substantially parallel to the first set of the adjacent pressurizable cells, each of the first set of adjacent pressurizable cells and the second set of adjacent pressurizable cells extending substantially across a width of the planar support, the adjacent pressurizable cells of the first set being independently pressurizable from the adjacent pressurizable cells of the second set via at least one conduit that fluidly connects the adjacent pressurizable cells of the first set and at least one other conduit that fluidly connects the adjacent pressurizable cells of the second set, wherein no pressurizable cell of the first set communicates with any pressurizable cell of the second set.

2. The cushioning element of claim 1, wherein each pressurizable cell of the plurality of pressurizable cells includes:

a first bladder on a first surface of the planar support;

a second bladder on a second surface of the planar support; and an aperture defined through the planar support to establish communication between the first bladder and the second bladder.

3. The cushioning element of claim 2, wherein the first bladder of each pressurizable cell is substantially superimposed with the second bladder of the pressurizable cell.

4. The cushioning element of claim 2, comprising:

first bladders arranged substantially parallel to each other over the first surface of the planar support;

second bladders arranged substantially parallel to each other over the second surface of the planar support.

5. The cushioning element of claim 4, wherein the first bladder are defined from a first sheet of material and the second bladders are defined from a second sheet of material.

6. The cushioning element of claim 2, wherein the first bladder and the second bladder comprise a pliable material.

7. The cushioning element of claim 6, wherein a rigidity of the planar support exceeds a rigidity of the first bladder and the second bladder.

8. The cushioning element of claim 2, wherein the first bladder includes edges sealed against the planar support to define a first chamber.

9. The cushioning element of claim 8, wherein the second bladder includes edges sealed against the planar support to define a second chamber in communication with the first chamber by way of the aperture.

10. The cushioning element of claim 8, wherein the first bladder has a semi cylindrical shape.

11. The cushioning element of claim 10, wherein the second bladder has a semi cylindrical shape, the pressurizable cell defined by the first bladder and the second bladder being cylindrical in shape.

12. The cushioning element of claim 1, wherein the first set of adjacent pressurizable cells is adjacent to a first end of the planar support and the second set of adjacent pressurizable cells is adjacent to a second end of the planar support.

13. The cushioning element of claim 12, further comprising:

a third set of adjacent pressurizable cells between the first set and the second set.

14. The cushioning element of claim 13, wherein the first set, the second set, and the third set are pressurizable independently from one another.

* * * * *